United States Patent [19]

Focke

[11] Patent Number: 4,944,315

[45] Date of Patent: Jul. 31, 1990

[54] APPARATUS FOR THE PRODUCTION AND PACKAGING OF CIGARETTES

[75] Inventor: Heinz Focke, Verden, Fed. Rep. of Germany

[73] Assignee: Focke & Co. (GmbH & Co.), Verden, Fed. Rep. of Germany

[21] Appl. No.: 285,455

[22] Filed: Dec. 16, 1988

[30] Foreign Application Priority Data

Dec. 18, 1987 [DE] Fed. Rep. of Germany ..... 3742955

[51] Int. Cl.[5] ..... A24C 5/35

[52] U.S. Cl. ..... 131/283; 131/282; 198/347.1; 198/572

[58] Field of Search ..... 131/283, 282; 198/347, 198/572, 580, 831

[56] References Cited

U.S. PATENT DOCUMENTS 4,751,996 6/1988 Knecht ..... 198/347

FOREIGN PATENT DOCUMENTS 1578138 11/1980 United Kingdom ..... 131/283

2061858 5/1981 United Kingdom ..... 131/282

*Primary Examiner*—V. Millin

*Assistant Examiner*—Joe H. Cheng

*Attorney, Agent, or Firm*—Sughrue, Mion, Zinn, Macpeak & Seas

[57] ABSTRACT

Apparatus for the production and packaging of cigarettes. In the production and packaging of cigarettes, the capacities of, where appropriate, several cigarette-producing machines (10, 11, 12) have to be coordinated with the productive capacities of, where appropriate, several packaging machines (13, 14). The cigarettes (15) are conveyed directly from the cigarette-producing machines to the packaging machines by means of cigarette conveyors. A cigarette store (16) for compensating differences in output is located in the region of the conveying zone. The cigarette store (16) makes it possible to achieve closer matching to the productive capacity of the coupled machines by avoiding the use of the conventional blind-end store. The cigarette store (16) is designed as a continuous-flow store in the form of a circular ring, to which the cigarettes delivered by the cigarette-producing machines (10, 11, 12) are fed at various locations, particularly in the region of entry stations (37, 38, 39), and from which cigarettes are extracted in the region of extraction stations (40, 41) for further conveyance to the packaging machines (13, 14). In the region of the closed cigarette store (16) in the form of the circular ring, a storage stream (43) is constantly conveyed in one direction and, thus, fed to the extraction stations (40, 41). The cigarette store (16) allows close matching to differences in output both in the feeding and in the extraction of the cigarettes. Furthermore, a careful treatment of the cigarettes is ensured by avoiding the effect of a blind-end store.

12 Claims, 4 Drawing Sheets

APPARATUS FOR THE PRODUCTION AND PACKAGING OF CIGARETTES

BACKGROUND OF THE INVENTION

The invention relates to an apparatus for the production and packaging of cigarettes, with at least one cigarette-producing machine and at least one packaging machine, the cigarette-producing machine and packaging machine being connected to one another by means of a cigarette conveyor which conveys a cigarette stream of cigarettes oriented transversely relative to the conveying direction from the cigarette-producing machine to the packaging machine and which has an arcuate cigarette store for receiving a cigarette stock.

In the large-scale production and packaging of cigarettes, an important precondition for achieving very high outputs is the most efficient possible coordination of the cigarette-producing machine or machines and packaging machine or machines. It is already known to couple cigarette-producing machines and packaging machines to one another directly for conveying purposes and feed the continuously produced cigarettes directly to a packaging machine by means of a cigarette conveyor. At the same time, a cigarette store can be formed in the region of the cigarette conveyor and receives a cigarette stock for compensating differences in output in the region of the cigarette-producing machine or the packaging machine.

In a known apparatus of this type (G.B. Patent Specification No. 1,299,174), the cigarette store is made arcuate, specifically either as an arc of a circle or a segment of an arc of a circle or helical. The cigarettes fed by means of the cigarette conveyor are partially introduced into the cigarette store which has arcuate conveyor belts driveable in one direction or the other. The cigarette store is designed as a blind-end store. The cigarettes are introduced and extracted for the emptying of the store at one and the same point.

Blind-end stores are disadvantageous for fundamental reasons, since considerable residues of cigarettes remain behind in the store over relatively long periods of time. These are then no longer suitable for use.

SUMMARY OF THE INVENTION

The object on which the invention is based is to develop further and improve an apparatus for the production and packaging of cigarettes in the version mentioned in the introduction, to the effect that, whilst careful treatment of the cigarettes ensured, an efficient conveyance of, where appropriate, several cigarette-producing machines to, where appropriate, several packaging machines is possible, with an effective cigarette store being provided.

To achieve this object, the apparatus according to the invention is characterised in that the cigarette store is designed as a continuous-flow store, to which cigarettes can be fed at at least one entry station and from which cigarettes can be conveyed away at at least one extraction station formed at a distance from the entry station.

According to the invention, the cigarette store which is annular or in the form of an arc of a circle consists of a plurality of storage belts which extend in a horizontal plane and which are constantly driven in one direction, in particular from an entry station to an extraction station. Several storage belts, each in the form of an arc of a circle, follow one another, to form a closed ring. Cigarettes are fed to this via several entry stations and extracted via several extraction stations. An entry station and an extraction station are formed respectively between successive arcuate storage belts.

A version in which three cigarette-producing machines are arranged underneath the annular cigarette store at approximately equal distances from one another is especially advantageous. The cigarettes produced are fed to the cigarette store via short cigarette conveyors with a vertical conveying portion. Two packaging machines of corresponding performance are arranged at a distance from the annular cigarette store. They are each fed from the cigarette store via an extraction station with a cigarette conveyor adjoining it tangentially, as seen in a plan view.

Thus, in the apparatus according to the invention, all the cigarettes flow through the cigarette store. No "residues" remain in this. The cigarette level in the cigarette store is monitored constantly. Control signals can be derived from this for operating the cigarette-producing machines on the one hand and the packaging machines on the other hand. Furthermore, in response to the measured cigarette level in the cigarette store, the drive speed of the storage belts can be varied, specifically, if necessary, individually for each storage belt.

The storage belts are designed so that an upper conveying strand for supporting the cigarettes is directed approximately horizontally, if appropriate with a slightly descending inclination towards the mid-point. The storage belts or their strands are wider than the length of the cigarettes, so that these can rest freely on the storage belt or the conveying strand without lateral limitations. The storage belts are guided via frustoconical deflecting rollers.

Further features of the invention relate to the design of the cigarette store and of details of this and to the design of the cigarette conveyors.

An exemplary embodiment of the invention is explained in detail below with reference to the drawings. In these:

DETAILED DESCRIPTION OF THE PREFERRED EMBODIMENT

Figure 1:
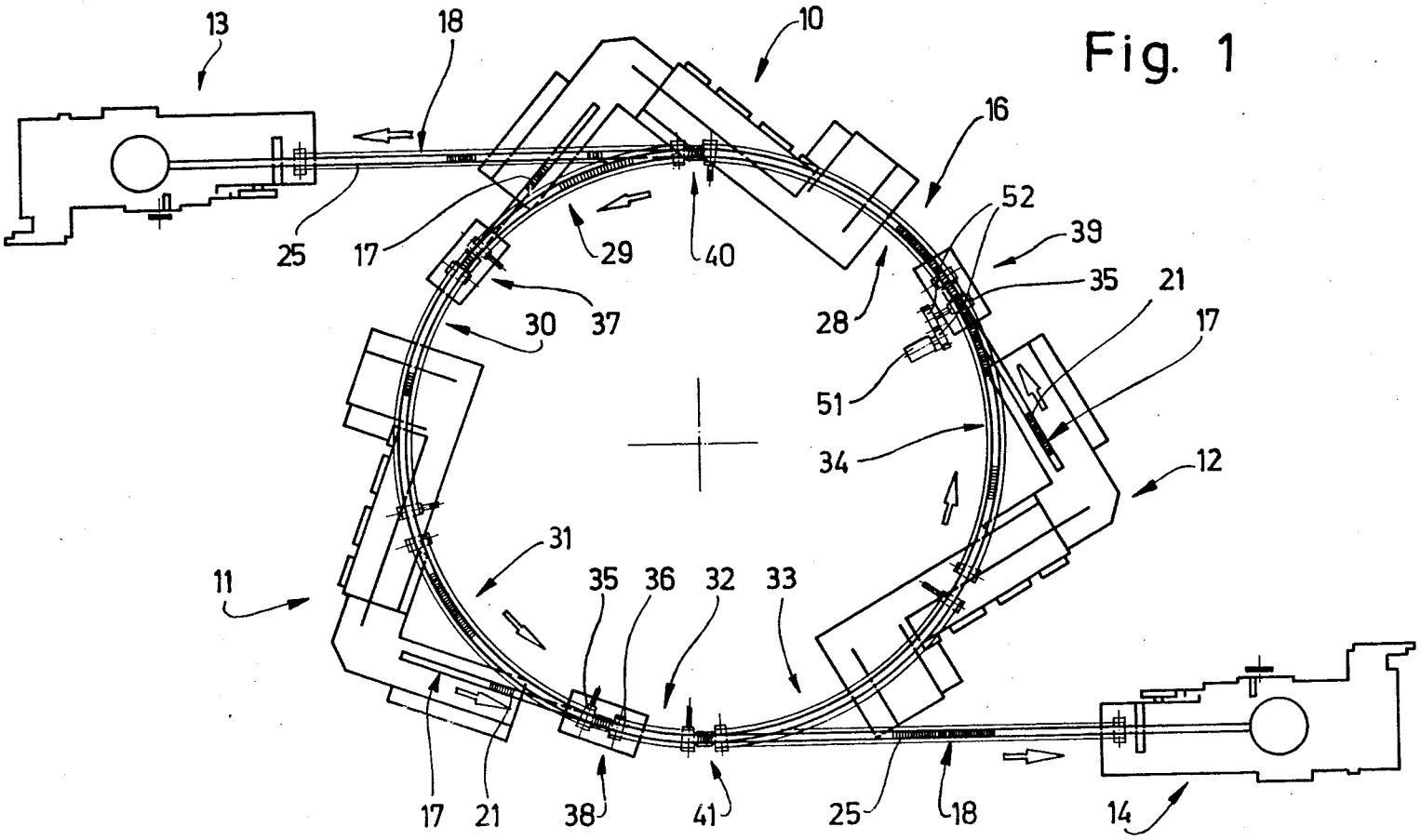
FIG. 1 shows a diagrammatic plan view of an exemplary embodiment of the apparatus.

In the industrial production and packaging of cigarettes, it is necessary to coordinate the performances of cigarette-producing machines on the one hand and packaging machines on the other hand, if the cigarettes are transferred directly from the cigarette-producing machine to packaging machines without relatively large intermediate stores.

In the exemplary embodiment illustrated, capacities are coordinated by assigning two packaging machines 13, 14 to three cigarette-producing machines 10, 11, 12. The construction and mode of operation of the cigarette-producing machines 10, 11, 12, on the one hand, and of the packaging machines 13, 14, on the other hand, can be of a conventional kind.

The cigarettes 15 produced by the cigarette-producing machines 10, 11, 12 are fed to a common distributor or cigarette store 16 and, according to the capacity, transferred from this to the packaging machines 13, 14. The cigarette store 16 is in the form of a circular ring, as seen in a plan view. Cigarette feed conveyors 17 coming from the cigarette-producing machines 10, 11, 12 transport the cigarettes 15 into the cigarette store 16. Appropriately designed cigarette discharge conveyors 18 feed the cigarettes 15 to the packaging machines 13, 14.

Figure 2:
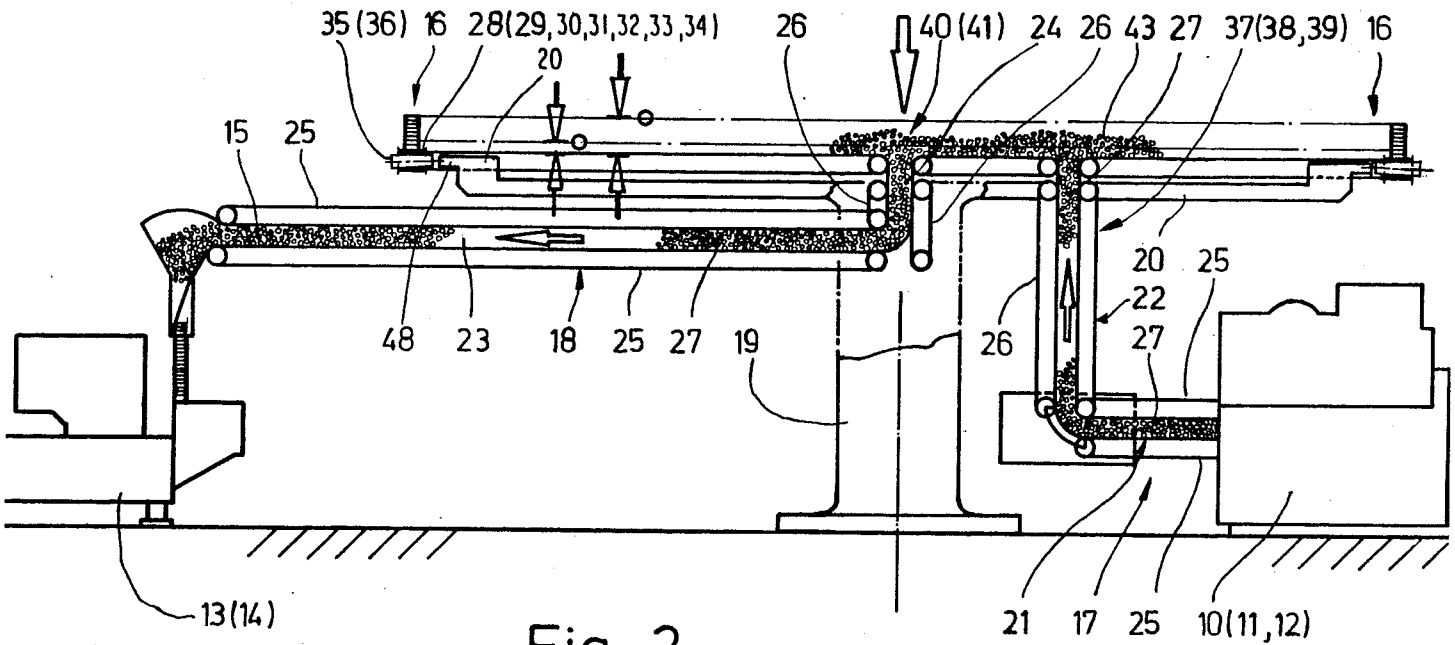
FIG. 2 shows a side view or diametral cross-section of the apparatus according to FIG. 1 on an enlarged scale.

The cigarette store 16 is arranged as a virtually closed circular conveyor track at a raised level, (as shown in FIG. 2) in particular above the cigarette-producing machines 10, 11, 12 and the packaging machines 13, 14, in the present exemplary embodiment on a central supporting column 19 with a circular supporting disc 20 attached to the upper end. The cigarette store 16 designed as a cigarette conveyor is located at the outer edge of the supporting disc 20.

The cigarette feed conveyors 17 of the cigarette-producing machines 10, 11, 12 consist of a horizontal conveyor 21 and of a vertical conveyor 22. The former directly adjoins cigarette-producing machines 10, 11, 12, whilst the vertical conveyor 22 opens into the cigarette store 16.

The cigarette discharge conveyor 18 likewise consists of a horizontal conveyor 23 and of a vertical conveyor 24.

The cigarette feed conveyors 17 and cigarette discharge conveyors 18 consist of conveyor belts, in particular horizontal belts 25 and vertical belts 26. A cigarette stream 27 is conveyed between two respective horizontal belts 25 arranged at a distance from one another and between two vertical belts 26 arranged at a distance from one another. This cigarette stream 27 consists of cigarettes 15 which are oriented transversely relative to the conveying direction and which are directed parallel to one another, but otherwise lack any order. The dimensions of the conveyor belts (horizontal belts and vertical belts) and the distances between the conveying strands of these are selected so that, when they experience a driving movement in the same direction, a cigarette stream 27 constantly moving further is obtained.

In the present example, the horizontal conveyors 21 and 23 are directed tangentially to the circular cigarette store 16, as seen in a plan view of the apparatus. The cigarettes 15 are fed to this from below. Likewise, the cigarettes 15 are extracted from the cigarette store 16 in a downward direction.

The cigarette store 16 consists of several storage belts 28 to 34 which are in the form of an arc of a circle and which complete one another to form a closed circle. Each of these storage belts 28 to 34 is guided via frustoconical rollers, in particular a drive roller 35 and a deflecting roller 36 respectively. The storage belts 28 to 34 are of differing length. The length of the storage belts 28 to 34 is determined, on the one hand, by the local positions of entry stations 37, 38 and 39 assigned to the cigarette feed conveyors 17 and, on the other hand, by the positions of extraction stations 40, 41 assigned to the cigarette discharge conveyors 18. The storage belts 28 to 34 end respectively in the region of the abovementioned stations. Furthermore, the length of the storage belts 28 to 34 is determined by a technically appropriate limitation, as where the storage belts 30, 31 and 33, 34 are concerned. The storage belt 32 has a relatively short length because of the close proximity of the entry station 38 and the extraction station 41.

Figure 4:
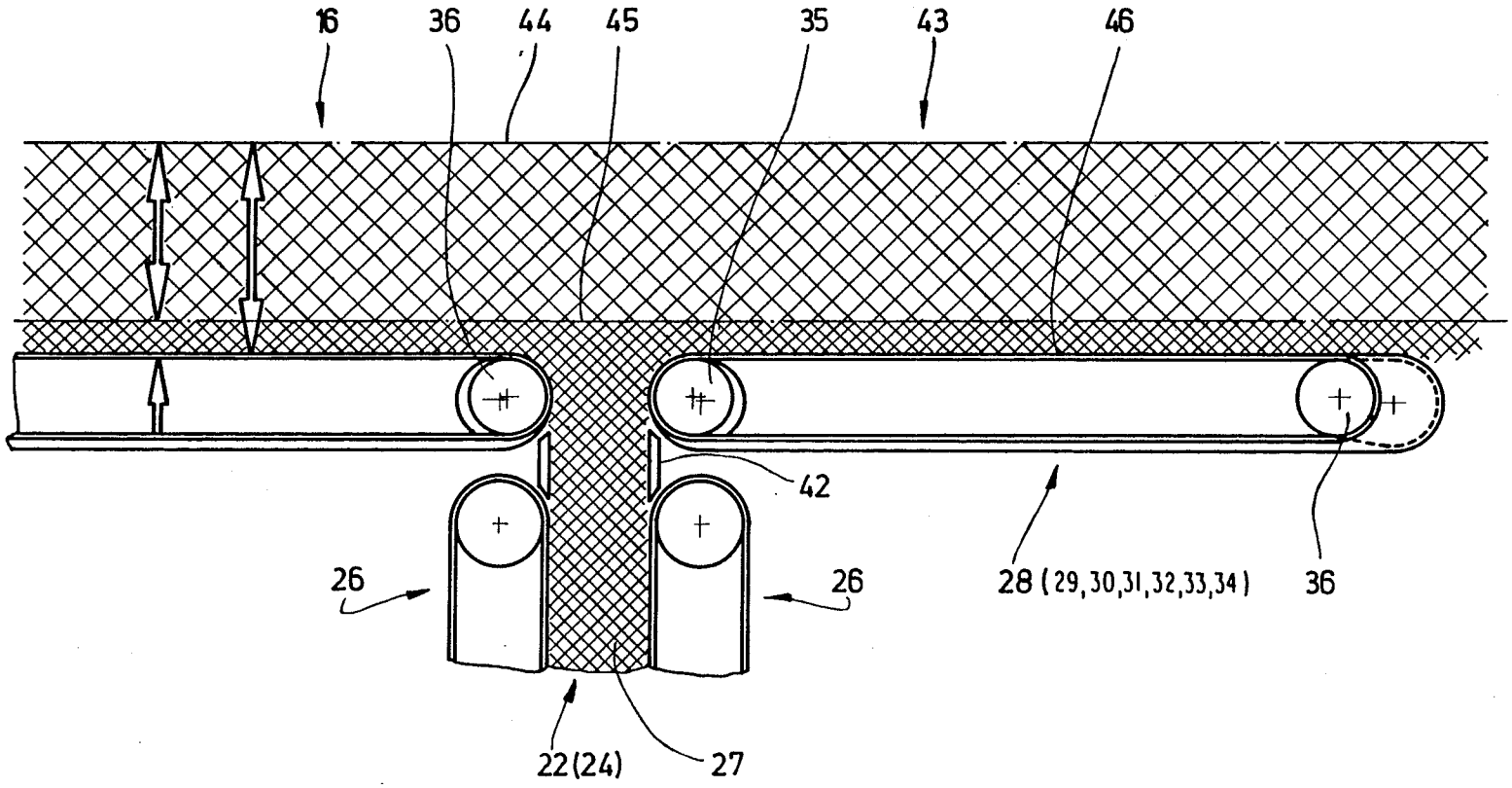
FIG. 4 shows a side view or vertical section of a portion of the cigarette store.

The drive roller 35 and deflecting roller 36 of adjacent storage belts 28 to 34 are arranged at a mutual distance from one another respectively in the region of the said stations 37 to 41. A vertical conveyor 22 or 24 of the cigarette feed conveyors 17 and of the cigarette discharge conveyors 18 opens respectively into this region. As is evident particularly from FIG. 4, vertical belts 26 end at a distance below the storage belts 28 to 34. A small gap is bridged by lateral guide walls 42. Above these, the cigarette stream 27 conveyed upwards passes into the effective range of the adjacent storage belts 28 to 34. These cause a deflection of the cigarette stream 27 into the plane of the cigarette store 16 and further transport along the circular path of the latter, always in the same direction.

In the region of the cigarette store 16, an annular storage stream 43 consisting of approximately radially oriented cigarettes 15 and of differing level forms. This is monitored by suitable checking members (light barriers or the like), in such a way that the storage stream 43 is set between a maximum level 44 and a minimum level 45. The former has a height of, for example, 30 cm and the latter a height of 5 cm, so that, in the exemplary embodiment described, the storage region has a height of 25 cm.

In the region of the extraction station 40, 41, part of the storage stream 43 is guided downwards into a vertical conveyor 24 arranged between adjacent storage belts 28 to 34, for feeding to a packaging machine 13, 14. In this way, a cigarette stream 27 corresponding to the processing capacity of the packaging machine 13, 14 is constantly maintained in the cigarette discharge conveyors 18.

Figure 3:
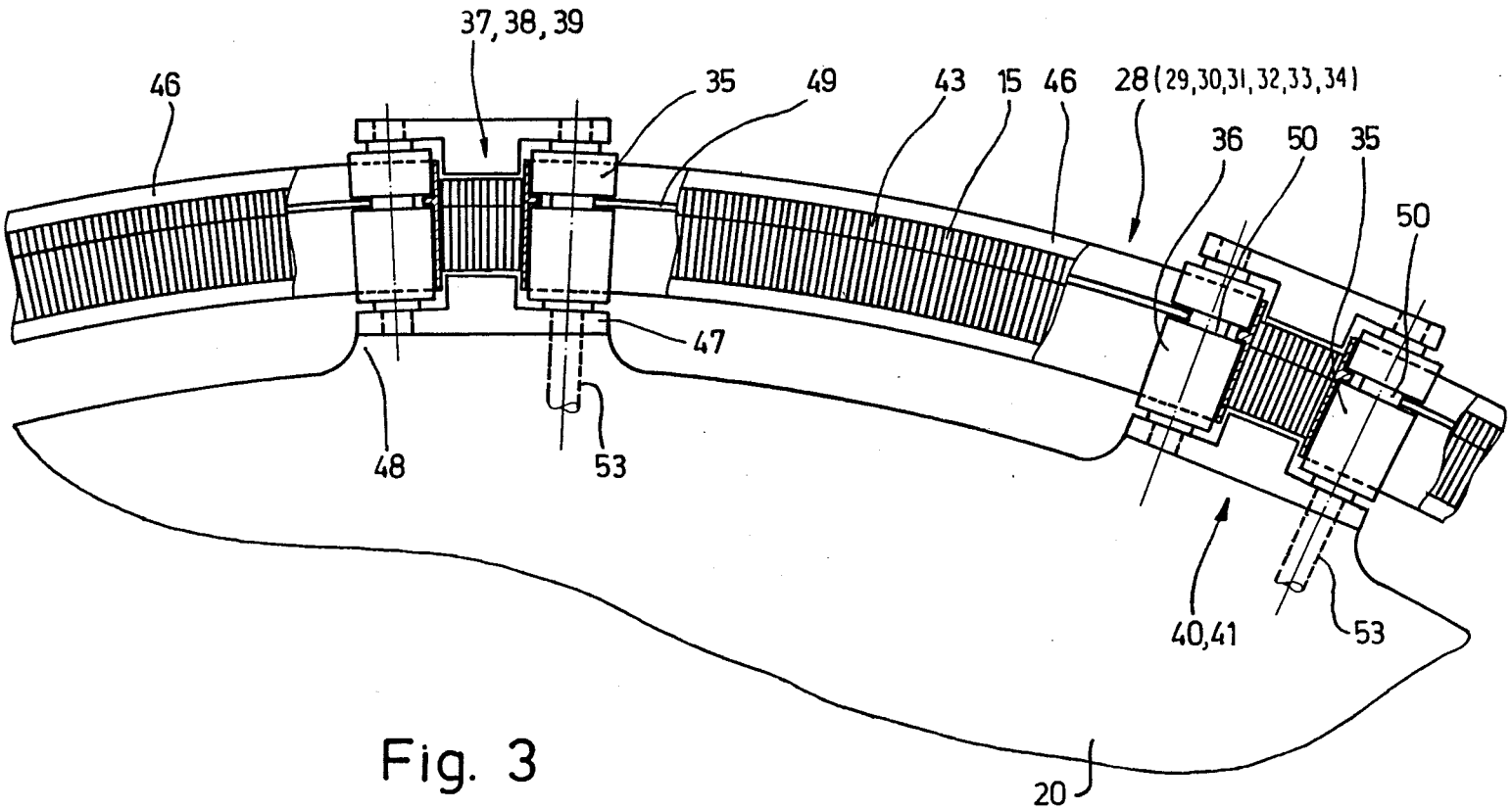
FIG. 3 shows a plan view of a part of a cigarette store on a further-enlarged scale.

The storage belts 28 to 34 are arranged in such a way that a respective upper strand 46 forms a support for the cigarettes 15 or for the content of the cigarette store 16 (as shown in FIG. 3). The storage belts 28 to 34 are very clearly wider than the length of the cigarettes 15. The latter lie on the storage belts 28 to 34 transversely relative to the longitudinal direction of these, specifically without lateral limitations or guides. The formation of the transversely or radially oriented cigarettes is relatively dimensionally stable, so that there is no need for lateral guides on the storage belts 28 to 34.

Each storage belt 28 to 34 is carried by a drive roller 35 and a deflecting roller 36. The rollers of radially directed axes are mounted on the outer edge of the supporting disc 20, specifically on a vertical supporting wall 47 in the region of a radially outward-directed projection 48 of the supporting disc 20. The drive roller 35 and the deflecting roller 36 are made frustoconical with a smaller diameter on the radially inner side. The trend of the storage belts 28 to 34 in the form of an arc of a circle is obtained thereby. Formed on the underside of each of these is repectively a raised portion forming a continuous guide ring or web 49 which is in engagement with an annular groove 50 of the drive roller 35 and deflecting roller 36. This positive mounting of the storage belts 28 to 34 on the drive roller 35 and deflecting roller 36 prevents them from shifting transversely on the rollers.

Assigned to each storage belt 28 to 34 is a drive motor 51. This is mounted on the supporting disc 20 on the inside of the storage belts 28 to 34. The drive motor 51 is in engagement with the shaft 53 of the drive roller 35 via driving wheels 52. The storage belts 28 to 34 driven in the same direction cause the storage stream 43 to be transported constantly in one direction of the cigarette store 16. As a result of a variation of the level in the range between the maximum level 44 and minimum level 45, cigarettes are fed to the storage stream 43 in the region of the entry stations 37, 38, 39 and extracted in the region of the extraction stations 40, 41. Depending on the instantaneous productive or receiving capacity of the cigarette-producing machines 10, 11, 12 on the one hand and of the packaging machines 13, 14 on the other hand, the storage belts 28 to 34 can be driven at different speeds, also in relation to one another, so that differences in the region of the cigarette feed or in the region of the cigarette extraction are compensated.

What is claimed is:

1. In an apparatus for the production and packaging of cigarettes and containing at least one cigarette producing machine and at least one packaging machine, the cigarette producing machine and the packaging machine being connected to one another by a cigarette conveyor which conveys a stream of cigarettes and which is oriented transversely relative to a conveying direction from the cigarette producing machine to the packaging machine, the improvement wherein:

said cigarette conveyor comprises: a circular cigarette store (16) designed as a continuous-flow store for receiving a stream of cigarettes; means for feeding cigarettes (15) to said circular cigarette store (16) from at least one entry station (37, 38, 39); and means for extracting said cigarettes (15) from said circular cigarette store (16) at at least one extracting station (40, 41), said extraction station being spaced from the entry station; and said circular cigarette store (16) comprises a plurality of driven storage belts (28, 29, 30, 31, 32, 33, 34) which form a closed circular ring and which have a respective upper strand (46) which is guided in a horizontal plane and on which the cigarette stream (43) is stored and conveyed from an entry station to an extraction station.

2. Apparatus according to claim 1, comprising means for driving the storage belts (28 to 34) in only one direction of the circular cigarette store (16).

3. Apparatus according to claim 1, characterised in that three cigarette-producing machines (10, 11, 12) and two packaging machines (13, 14) are assigned to the circular cigarette store (16), each cigarette-producing machine (10, 11, 12) having an entry station (37, 38, 39) and each packaging machine (13, 14) having an extraction station.

4. Apparatus according to claim 3, characterised in that the entry stations (37, 38, 39) and the extraction stations (40, 41) are arranged distributed along the circumference of the circular cigarette store an adjacent entry station (37, 38, 39) and extraction station (40, 41) being connected respectively to one another by means of a storage belt (28 to 34).

5. Apparatus according to claim 4, characterised in that the cigarettes (15) are fed to the circular cigarette store (16) from below and extracted in a downward direction, respectively, in a region of storage belts (28 to 34) succeeding one another in the circumferential direction of said circular cigarette store (16).

6. Apparatus according to claim 5, characterised in that the three cigarette-producing machines (10, 11, 12) are arranged underneath the circular cigarette store (16) at approximately equal distances from one another and are connected to the circular cigarette store (16) by means of cigarette feed conveyors (17) consisting of a horizontal conveyor (21) and of a vertical conveyor (22).

7. Apparatus according to claim 5, characterised in that the two packaging machines (13, 14) are arranged at a distance from the circular cigarette store (16) and are connected to the circular cigarette store via a cigarette discharge conveyor (18) with a horizontal conveyor (23) and with a vertical conveyor (24).

8. Apparatus according to claim 1, characterised in that the storage belts (28 to 34), which form the closed circular ring, are spaced apart from one another at a mutual distance.

9. Apparatus according to claim 1, characterised in that the storage belts (28 to 34) extend in the form of an arc of a circle and are guided via a drive roller (35) and a deflecting roller (36) and are retained on these rollers by a guide rib (49) which enters an annular groove (50) of the drive roller (35) and deflecting roller (36) and which is located on the underside of the storage belts (28 to 34).

10. Apparatus according to claim 1, characterised in that the storage stream (43) of cigarettes rests on the upper strand (46) of the storage belts (28 to 34) without lateral limitation and lateral guidance, the upper strand (46) being substantially wider than a length of the cigarettes (15).

11. Apparatus according to claim 1, characterised in that the storage belts (28 to 34) are arranged on the outer circumference of a circular supporting disc (20) with a central supporting column (19).

12. In an apparatus for the production and packaging of cigarettes and containing at least one cigarette producing machine and at least one packaging machine, the cigarette producing machine and the packaging machine being connected to one another by a cigarette conveyor which conveys a stream of cigarettes and which is oriented transversely relative to a conveying direction from the cigarette producing machine to the packaging machine, the improvement wherein:

said cigarette conveyor comprises: a circular cigarette store (16) designed as a continuous-flow store for receiving a stream of cigarettes; means for feeding cigarettes (15) to said circular cigarette store (16) from at least one entry station (37, 38, 39); and means for extracting said cigarettes (15) from said circular cigarette store (16) at at least one extraction station (40, 41), said extraction station being spaced from the entry station;

said circular cigarette store (16) comprises a plurality of driven storage belts (28, 29, 30, 31, 32, 33, 34) which form a closed circular ring and which have a respective upper strand (46) which is guided in a horizontal plane and on which the cigarette stream (43) is stored and conveyed from an entry station to an extraction station; and wherein three cigarette producing machines (10, 11, 12) and two packaging machines (13, 14) are assigned to the circular cigarette store (16), each cigarette-producing machine (10, 11, 12) having an entry station (37, 38, 39) and each packaging machine (13, 14) having an extraction station at the circular cigarette store (16);

wherein the entry stations (37, 38, 39) and the extraction stations (40, 41) of the circular cigarette store (16) are arranged distributed along the circumference of the circular cigarette store, an adjacent entry station (37, 38, 39) and extraction station (40,

41) being connected respectively to one another by means of a storage belt (28 to 34);

wherein the cigarettes (15) are fed to the circular cigarette store (16) from below and extracted in a downward direction, respectively, in a region of storage belts (28 to 34) succeeding one another in the circumferential direction of said circular cigarette store (16); and wherein the storage belts (28 to 34) extend in the form of an arc of a circle and are guided via a drive roller (35) and a deflecting roller (36) and are retained on these rollers by a guide rib (46) which enters an annular groove (50) of the drive roller (35) and deflecting roller (36) and which is located on the underside of the storage belts (28 to 34).

* * * * *